United States Patent [19]

Bouchez et al.

[11] Patent Number: 4,941,750

[45] Date of Patent: Jul. 17, 1990

[54] MOVING AGITATOR MEMBER FOR APPARATUS FOR MIXING SUBSTANCES IN POWDER, PASTE, OR GRANULAR FORM

[75] Inventors: Alain Bouchez, Vincennes; Patrice Cognard, Boulogne; Marie Geárard, Rueil Malmaison; Alain Schmidt, Mesnil Le Roi, all of France

[73] Assignee: Societe Anonyme: Moritz, France

[21] Appl. No.: 289,681

[22] Filed: Dec. 27, 1988

[30] Foreign Application Priority Data

Dec. 30, 1987 [FR] France ..... 87 18546

[51] Int. Cl.[5] ..... B01F 7/20; B01F 15/06

[52] U.S. Cl. ..... 366/147; 366/314; 366/325

[58] Field of Search ..... 366/147, 139, 65, 98, 366/279, 309, 314, 325, 328, 343, 326, 169, 330, 327, 329, 310, 270; 416/90 R, 92, 232, 233, 238, 239, 248; 165/109.1, 86, 88, 92; 422/135, 225, 226

[56] References Cited

U.S. PATENT DOCUMENTS

| | | | |
|---|---|---|---|
| 1,505,479 | 9/1924 | Maitland | 366/147 |
| 1,665,789 | 4/1928 | Nichols | 416/232 X |
| 2,015,397 | 9/1935 | Eppler | 366/309 X |
| 2,982,522 | 5/1961 | Hamilton | 257/104 |
| 3,201,095 | 8/1965 | Erwien et al. | 366/325 X |
| 3,241,606 | 3/1966 | Honjo et al. | 165/86 |
| 3,348,816 | 10/1967 | Cox | 366/325 X |
| 3,387,651 | 6/1968 | Berker | 165/109.1 |
| 3,397,869 | 8/1968 | Webster | 366/327 |
| 3,531,092 | 9/1970 | Praschak et al. | 366/279 X |
| 3,884,294 | 5/1975 | Lodige et al. | 165/92 |
| 3,893,811 | 7/1975 | Good et al. | 366/147 X |
| 4,045,185 | 8/1977 | Azemar et al. | 366/147 X |
| 4,467,080 | 8/1984 | Brun et al. | 422/135 X |
| 4,722,608 | 2/1988 | Salzman et al. | 366/343 X |
| 4,729,878 | 3/1988 | Pommier et al. | 422/135 |

FOREIGN PATENT DOCUMENTS

| | | | |
|---|---|---|---|
| 079396 | 5/1983 | European Pat. Off. . | |
| 131885 | 10/1983 | European Pat. Off. . | |
| 2525362 | 12/1976 | Fed. Rep. of Germany . | |
| 2735388 | 7/1978 | Fed. Rep. of Germany | 366/343 |
| 2273582 | 10/1976 | France . | |
| 278574 | 2/1952 | Switzerland | 366/314 |
| 389656 | 7/1965 | Switzerland | 366/314 |

*Primary Examiner*—Harvey C. Hornsby
*Assistant Examiner*—Scott J. Haugland
*Attorney, Agent, or Firm*—Bacon & Thomas

[57] ABSTRACT

A moving agitator member for mixing various different substances. In accordance with the invention is characterized in that said blade segment (17) is in the form of a half-crescent and tapers away from the blade root (16), and is twisted, at least in its terminal portion through an angle $\gamma$ towards the axis of rotation; and the blade root (16) and the blade segment (17) have a right cross-section which is triangular in shape. It is applicable to preparing industrial products.

5 Claims, 4 Drawing Sheets

X-X'
14
15
14
13
12
VI
V
VI
V
α
Y-Y'
16
22
18
17
24
19
23
f1
11
21
IV
2a
IV

P5
23
20
VIII
P4
24
β
11
X-X'
17
P3
VIII
P2
12
P1
19
δ
P
16

MOVING AGITATOR MEMBER FOR APPARATUS FOR MIXING SUBSTANCES IN POWDER, PASTE, OR GRANULAR FORM

The invention relates to mixing, stirring, kneading, or agitating substances in powder, paste, or granular form within a confinement enclosure under an atmosphere which may inert or reactive, at relative pressure and/or at relative temperature.

BACKGROUND OF THE INVENTION

The terms "mixing" and "stirring" should be understood as covering any pure mixing operation between at least two ingredients which are to be homogenized, together with any operation having the purpose of changing the state of one or more basic substances or one or more compounds by reacting under various ambient conditions of pressure, temperature, or interaction, with or without modification of ambient conditions.

Of the numerous applications that may be envisaged, it is appropriate to mention the fabrication of raw materials, the preparation of industrial substances such as paint, polymers, glue, plastics, the fabrication of chemical substances which are purely and solely industrial in character, or foodstuffs, or pharmaceutical substances.

Substances or compositions which are in powder, paste, or granular form are stirred or agitated inside receptacles, vats, or enclosures which are generally closed having a drive shaft passing locally therethrough with a moving agitator member constituting a hub and a given number of blades fixed thereon.

Various forms of vat have been adopted for performing such an operation, and the corresponding agitator members are appropriately shaped, generally to ensure that the blades move as close as possible to the corresponding portions of the inside face of the vat.

The following patent documents are mentioned by way of example: DE-A-25 25 362, EP-A-O 131 885, and U.S. Pat. No. 2 982 522.

Experience shows that presently available apparatuses leave room for improvement concerning the functions of stirring, kneading, mixing, or homogenizing the substances that they are to work on.

A first such possibility relates to the profile of the blades for improving energetic stirring of substances contained in the receptacle or vat of the apparatus while avoiding setting up preferred lines of motion. It has been observed that the varying number of blades on the agitator cannot solve this problem, which must be solved as a function of the particular shape of the blades.

Another object of the invention is to improve blade strength in the face of intense mechanical forces which increase with increasing drive torque and with increasing viscosity of the substances to be stirred.

Another object is to regulate the internal or core temperature of the substances or the composition being stirred either in order to prevent an increase in temperature due to stirring friction or else, in contrast, to add or remove heat so as to encourage an intimate reaction under an atmosphere which may be inert or reactive.

The present invention seeks to achieve the above objects by proposing a novel moving agitator member designed to:

further improve energetic stirring and homogenization of substances being treated, be they substances in powder, paste, or granular form;

considerably increase the mechanical strength of the blades, thereby enabling a high level of torque to be transmitted even within a mass of paste, powder, or liquid having a high level of viscosity; and enable narrower temperature regulation within the core of the substances being kneaded or mixed by virtue of blades which also operate as heat exchangers.

SUMMARY OF THE INVENTION

The present invention provides a moving agitator member for apparatus for mixing substances in powder, paste, or granular form, of the type comprising a hub suitable for fitting to the terminal portion of a drive shaft projecting into a receptacle constituting the apparatus, said hub possessing n shaped blades each having a leading edge following the corresponding inside face of the receptacle as closely as possible, with each blade comprising:

a base suitable for fixing to the hub and centered on the axis of rotation x—x′ thereof;

a blade root extending from the outside face of the base along a direction which is substantially radial relative to the axis of rotation x—x′; and a curved blade segment running on from the blade root and rising at an angle $\beta$ relative to the axis of rotation x—x′, sweeping rearwardly in order to present its convex leading edge in the direction of rotation of the moving member;

wherein:

said blade segment is in the form of a half-crescent and tapers away from the blade root, and is twisted, at least in its terminal portion through an angle $\gamma$ towards the axis of rotation; and the blade root and the blade segment have a right cross-section which is triangular in shape.

The invention also provides apparatus for mixing substances in powder, paste, or granular form, the apparatus comprising a receptacle, vat, or enclosure having a drive shaft passing locally therethrough and having a moving agitator member in accordance with the invention mounted thereon.

BRIEF DESCRIPTION OF THE DRAWINGS

An embodiment of the invention is described by way of example with reference to the accompanying drawings, in which.

MORE DETAILED DESCRIPTION

Figure 1:
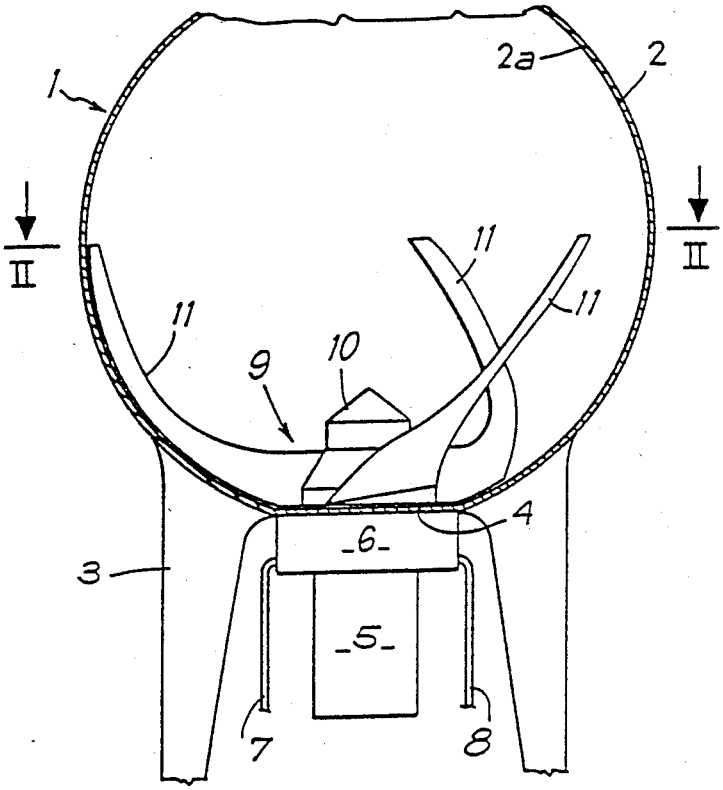
FIG. 1 is a diagrammatic section view in elevation through apparatus for stirring, mixing, or kneading purposes fitted with a moving agitator member in accordance with the invention.
Figure 2:
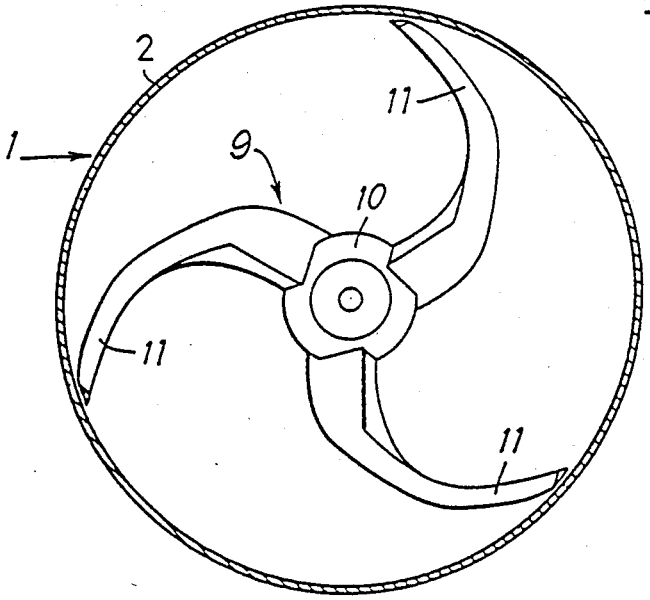
FIG. 2 is a plan view in section taken on line II—II of FIG. 1.

FIGS. 1 and 2 show an apparatus 1 for agitating, mixing, stirring, kneading or reacting a substance or composition in powder, paste, or granular form. Such an apparatus 1 comprises a vat, a receptacle, or an enclosure 2 which is shown by way of non-limiting example as being spherical in shape, which vat is supported by a structure 3. The outlet shaft from a motor and stepdown gear unit 5 of any appropriate type passes through the vat 2, e.g. through its flat bottom 4. The outlet shaft is associated with a stuffing box 6 having rotary seals and connected to a go circuit 7 and a return circuit 8 which are connected to an installation 35 for maintaining a flow of a heat-conveying fluid.

The portion of the drive shaft which projects into the vat 2 supports a moving agitator member 9 comprising a hub 10 having blades 11 extending therefrom, which blades are shaped in conventional manner to follow as closely as possible the corresponding portion of the inside face 2*a* of the vat 2 over which the blades move when the member 9 is rotated by means of the drive shaft being driven by the unit 5.

By way of example, the moving agitator member 9 is shown as being provided with three blades 11, but it should be understood that some other number of blades may be provided.

The invention relates, particularly, to the structure of the blades 11 and not to the structure of the hub 10 which should be considered as forming part of the prior art with respect to its function of providing a mechanical connection to the drive shaft and with its function of transferring the heat-conveying fluid flowing along the circuits 7 and 8, via the box 6.

Figure 3:
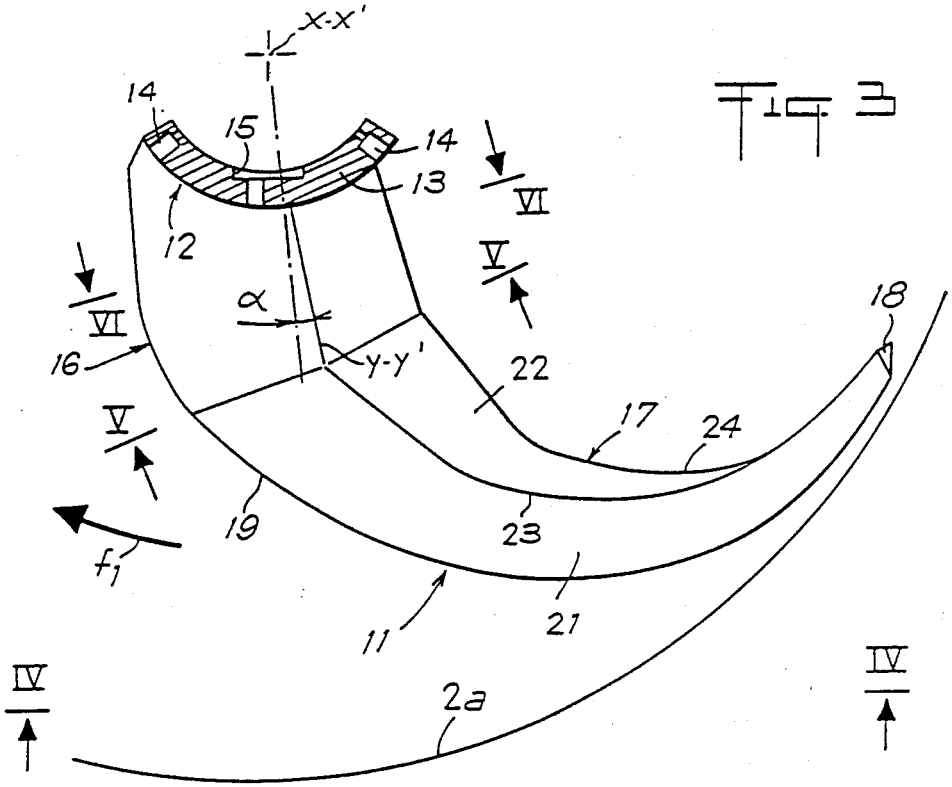
FIG. 3 is a plan view on a larger scale showing one of the component elements of the moving agitator member as shown in FIGS. 1 and 2.
Figure 4:
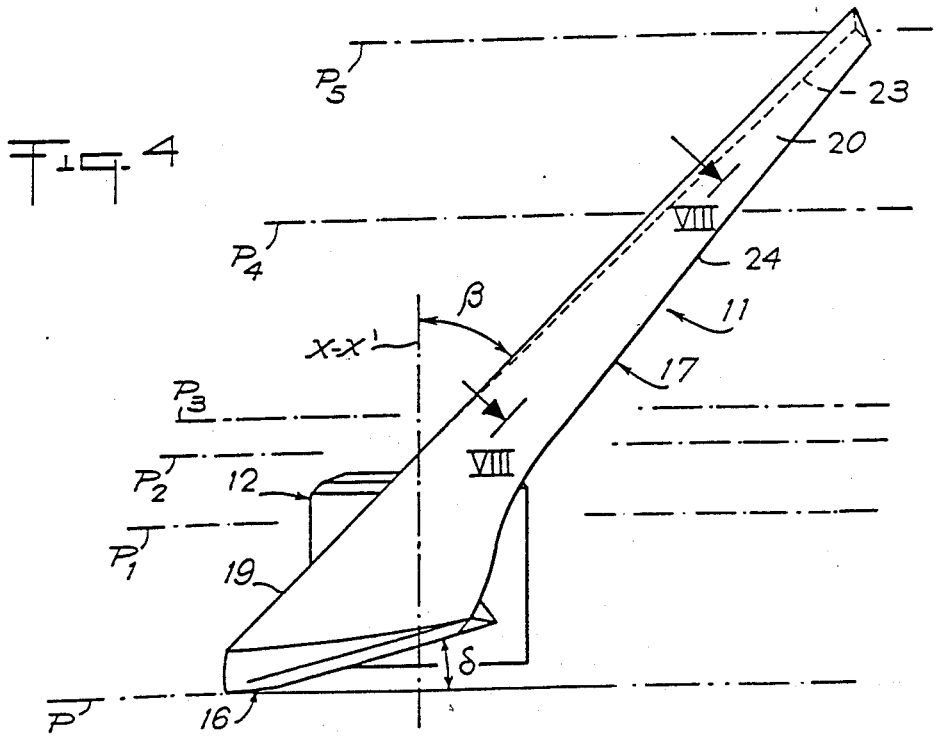
FIG. 4 is a side elevation taken substantially on line IV—IV of FIG. 3.

As can be seen in FIGS. 3 and 4, each blade 11 is designed to include a base 12 suitable for enabling it to be removably fixed to the hub 9 while being centered on the axis of rotation x—x′ thereof. To this end, the fixing base 12 may be constituted by a sector of a ring 13 suitable for being fixed by means of screws 14 which provide both radial and axial fixing. Effectively angular retention suitable for enabling rotary drive in the direction of arrow $f_1$, for example, is established by the presence of a key which is partially engaged in a housing 15 formed in the inside surface of the ring sector 13.

Going from its outer peripheral surface, the fixing base 12 supports a blade root 16 having a general axis y—y′ which is substantially radial relative to the axis of rotation x—x′. The longitudinal axis y—y′ is preferably offset rearwardly relative to the direction of arrow $f_1$ away from a pure radial direction centered on the axis x—x′ by a value $\alpha$ lying in the range 5° to 30°.

The blade root 16 is extended by a blade segment 17 which is generally in the form of a half-crescent whose thickness tapers from its connection to the blade root 16 towards a marginal edge 18.

The blade segment 17 runs on from the blade root 16 and extends upwardly forming an angle $\beta$ lying in the range 20° to 60° relative to the axis x—x′. The angle $\beta$ is preferably close to 45°.

The blade segment 17 in the form of a half-crescent is curved and sweeps in a rearwards direction relative to the direction of rotation shown by arrow $f_1$, thereby ensuring that its convex edge constitutes the leading edge 19 of the blade 11, and that said edge follows as closely as possible the inside face 2*a* over which the blade 11 moves during rotation in the direction indicated by arrow $f_1$.

The blade root 16 and the blade segment 17 are made in the form of hollow sections and are made of any appropriate substance. It is preferable for the hollow section used to be generally triangular in shape in any substantially right cross-section.

Figure 5:
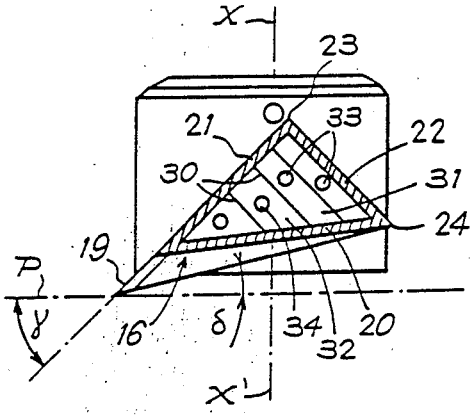
FIG. 5 and FIG. 6 are sections in elevation taken respectively on lines V—V and VI—VI of FIG. 3.
Figure 6:
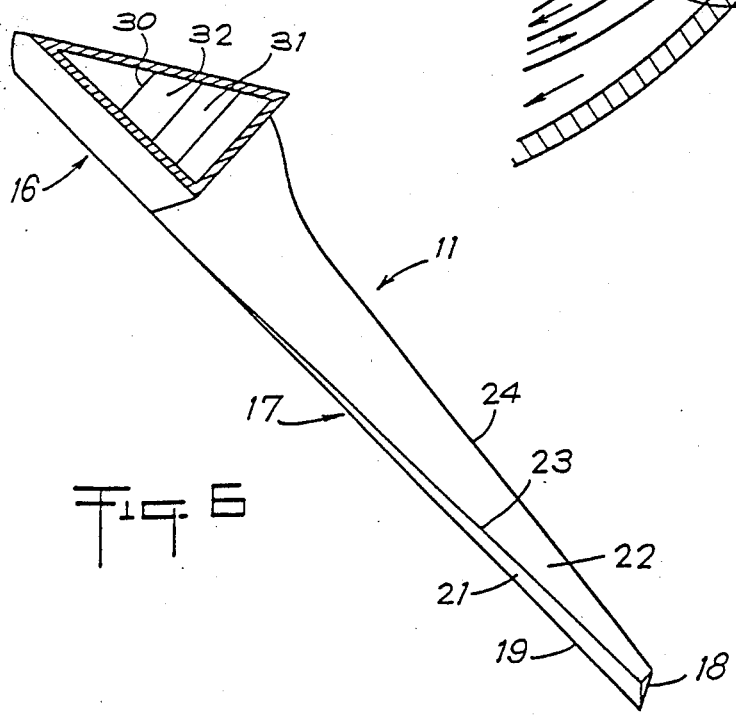

By way of example, FIGS. 4 to 6 show that the blade root 16 and the blade segment 17 may be made in the form of a triangular hollow section comprising a bottom wall 20 forming a bottom surface, a wall 21 forming a leading upper surface (relative to the direction of rotation as indicated by arrow $f_1$), and a wall 22 forming a trailing upper surface relative to the same direction of rotation. The walls 20 to 22 are interconnected to form the leading edge 19 between the bottom surface 20 and the leading upper surface 21, a ridge 23 between the leading and trailing upper surfaces 21 and 22, and a trailing edge 24 between the trailing upper surface 22 and the bottom surface 20. As can be seen in FIG. 3, the ridge 23 and the trailing edge 24 are concave in shape.

The blade root 16 extended by the blade segment 17 is fixed to the base 13, e.g. by welding, in such a manner that the leading upper surface 21 forms an angle $\gamma$ relative to a reference plane P perpendicular to the axis x—x′, with the angle $\gamma$ lying in the range 30° to 60°, and preferably being close to 45°. This fixing is also performed in such a manner that the bottom surface 20 extends from its origin at the base 13 and along the blade relative to the same reference plane P at an angle $\delta$ referred to as the clearance angle whose value may lie between 10° and 20°, and may be around 13°, for example. The angle $\delta$ is provided to avoid clogging of the substances being kneaded, and to facilitate cleaning.

Figure 7:
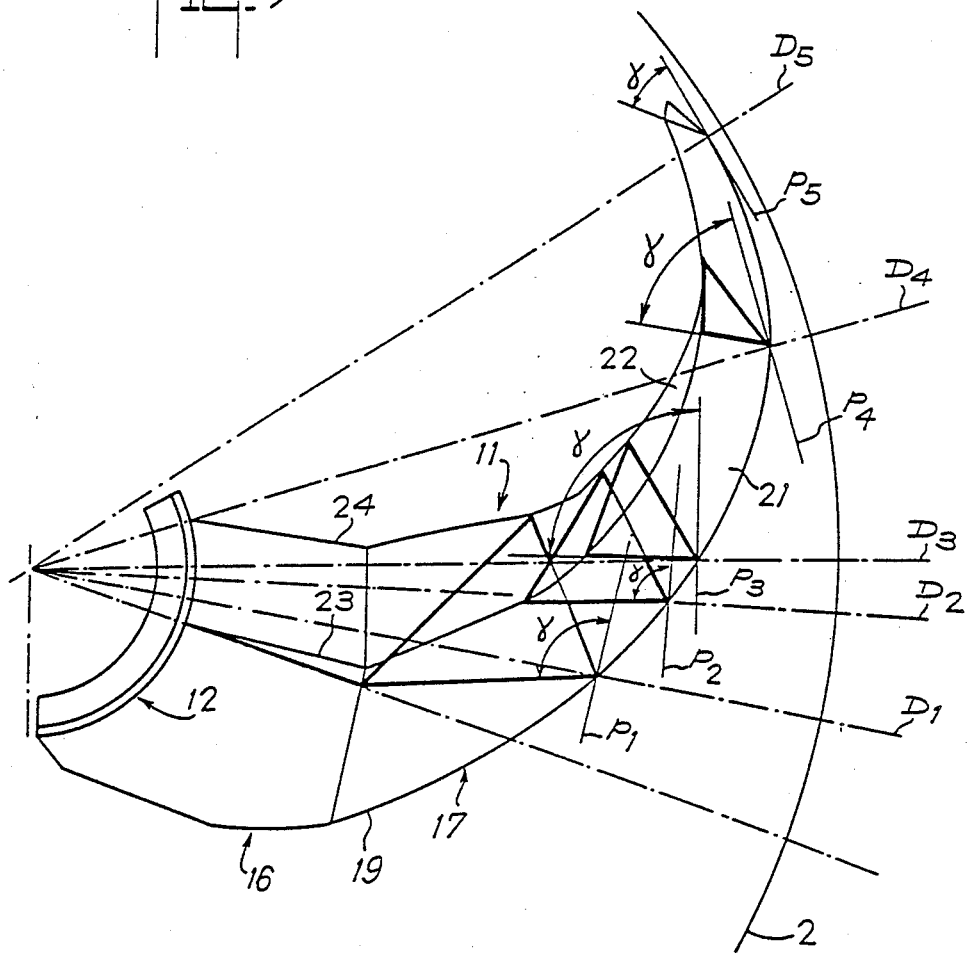
FIG. 7 is a plan view analogous to FIG. 2 but on a larger scale and illustrating constructional details of the invention.

The blade segment 17 is shaped so that the leading upper surface 21 is twisted towards the axis x—x′ running from its beginning at the blade root 16 and going towards the marginal edge 18. Such twisting may be expressed as variation in the angle $\gamma$ which, as shown in FIGS. 4 and 7 occupies values close to 105°, 95°, 90°, 60°, and 30° as measured in successive planes $P_1$ to $P_5$ between the cutting edge of leading upper surface 21 and the perpendicular p to the radial direction D connecting the axis x—x′ to the intersection of said cutting edge with the leading edge 19. The same reference coordinates make it possible to observe, in FIG. 7, the angle $\delta$ between the bottom surface 20 and the perpendiculars p.

The above-described shape for the blade 11 is provided for various purposes.

The first purpose due to its hollow section shape is to enable it to have particularly high mechanical strength so as to enable it to withstand the stresses resulting from the applied rotary torque or from the reaction presented by the more or less viscous nature of the substances being kneaded, stirred, or mixed.

Using a hollow section structure in combination with a blade segment 17 which is in the form of a half-crescent, makes it possible to reduce friction forces with increasing radial distance from the axis x—x′, thereby facilitating, at least to some extent, the forced passage of the blade 11 through the material, or the composition, or the substances being mixed.

Another advantage stemming from the selected shape lies in the fact that the half-crescent form of tapering width makes it possible to cause the speed gradients to increase continuously with increasing radius, thereby encouraging the stirring, kneading, or mixing effect which is further encouraged by the triangular section shape of the blade root 16 and the blade segment 17.

The hollow section triangular shape also makes it possible to impart particularly high mechanical strength to the blade 11 in the face of pressure variations which may occur within the vat 2, either by virtue of reactions between the substances being mixed therein, or else by virtue of the pressure therein being maintained at a pressure different from ambient.

The shape of the blade 11 is also selected in such a manner that the leading edge 19 defined by the blade root 16 performs a scraping function relative to the bottom of the vat 2, thereby limiting stagnation of a mass of substance subjected to little stress by virtue of the relatively low linear speed of displacement which is imparted to the substance or material at a short distance from the hub 10. The entire leading edge 19 also performs a scraping function by virtue of the special shape of the blade 11 which causes this leading edge to follow, more or less, the corresponding portion of the inside face 2a of the vat.

The special shape of the blade 11, and more particularly its triangular box section, makes it possible to establish a roll-off ridge 23 between the leading upper surface 21 and the trailing upper surface 22 having the effect of establishing a discontinuity in the flow of material or substances previously moved by the leading upper surface 21. Such a roll-off or break gives rise to turbulent motion immediately after the ridge 23, thereby encouraging stirring, kneading, mixing, or homogenization of the substances being treated.

Figure 8:
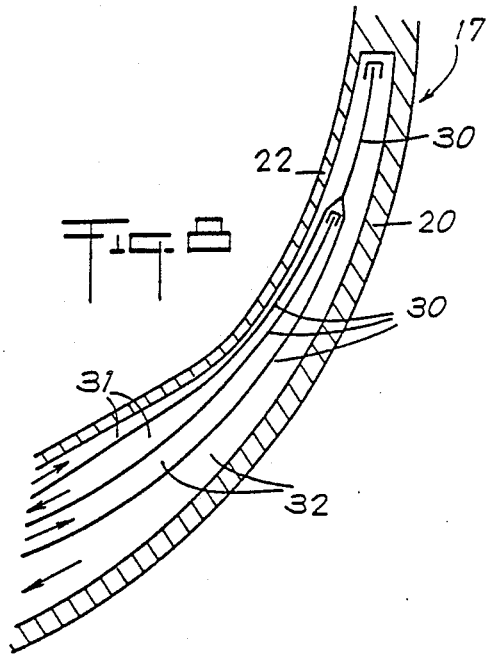
FIG. 8 is a fragmentary section on line VIII—VIII of FIG. 4.

In another advantageous disposition of the invention, the box section structure of the blade root 16 and of the blade segment 17 further includes internal partitioning constituted by walls 30 applied by any appropriate means. The walls 30 serve to reinforce the box section structure and are, in addition, organized in such a manner as can be seen in FIGS. 5 and 8 to delimit channels or compartments 31 or 32 inside the blade root 16 and inside the blade segment 17, which channels communicate with each other at the end of the blade and allow a heat-conveying fluid to flow inside the blade.

The channels 31 and 32 are in communication with passages 33 and 34 passing through the fixing base 12 so as to coincide with complementary ducts provided in the hub 10.

Thus, it becomes possible using such means to maintain a go and return flow of heat-conveying fluid inside each blade Il, thereby enabling each blade, considered overall, to act as a heat exchanger for regulating the temperature of the product or the composition being mixed either by inserting or by removing heat, as a function either of the increase in temperature due to the stirring or kneading, or else due to a reaction process taking place or developing due to interaction between the various components or products.

The walls 30 could alternatively be organized solely to provide a go circuit for feeding orifices in the blades via which a fluid is injected into the product, said orifices being porous or not porous.

The blade root 16 and the blade segment 17 may be made by assembling the walls 20 and 21, adding an assembly of partitioning walls 30, and terminated by assembling the wall 22.

The invention is not limited to the example described and shown and numerous modifications may be made thereto without going beyond the scope of the invention.

We claim:

1. A rotating agitator member for apparatus for mixing substances in powder, paste, or granular form, of the type comprising a hub suitable for fitting to the terminal portion of a drive shaft projecting into a receptacle constituting the apparatus, said hub processing n shaped blades each having a leading edge following the corresponding inside face of the receptacle as closely as possible, with each blade comprising:

a base suitable for fixing to the hub and centered on the axis of rotation x—x′ thereof;

a blade root extending from an outside face of the base along a direction which is substantially radial relative to the axis of rotation x—x ′; and a curved blade segment running on from the blade root and rising at an angle $\beta$ relative to the axis of rotation x—x′, said curved blade segment sweeping rearwardly in order to present a convex leading edge in the direction or rotation of the agitator member;

wherein:

said blade segment is in the form of a half-crescent whose thickness tapers away from the blade root, a leading surface of the curved blade segment being twisted relative to a reference plane perpendicular to the axis of rotation x—x ′, the blade root and the blade segment being made in the form of a hollow section member having a right cross section which is triangular in shape and which includes a bottom wall forming a bottom surface and two outer walls forming an upper surface, one of said outer walls including said leading surface and the bottom surface defining a clearance angle $\gamma$.

2. An agitator member according to claim 1, further comprising passages provided through the base and at least one duct provided in the hub, and wherein said hollow section member is partitioned by internal walls defining at least one flow circuit in communication with said passages provided through the base in order to communicate with said duct and connected to an installation for producing a fluid flow.

3. An agitator member according to claim 1, wherein said walls are interconnected to define an assembly having a convex leading edge, a concave roll-off ridge and a concave trailing edge.

4. An agitator member according to claim 3, wherein the angle between the leading surface and the reference plane gets smaller going from the blade root towards the marginal edge.

5. An agitator member according to claim 1, wherein the axis y—y′ of the blade root forms an angle $\alpha$ with a pure radial direction passing through the axis of rotation x—x′.

* * * * *